US008416140B2

(12) United States Patent
Mayes et al.

(10) Patent No.: US 8,416,140 B2
(45) Date of Patent: Apr. 9, 2013

(54) INTEGRATED RESONATOR AND DIPOLE FOR RADIATION OF HIGH POWER RF ENERGY

(76) Inventors: Jonathan R. Mayes, Austin, TX (US); Christopher Wilson Hatfield, Briarcliff, TX (US)

( * ) Notice: Subject to any disclaimer, the term of this patent is extended or adjusted under 35 U.S.C. 154(b) by 925 days.

(21) Appl. No.: 12/509,576

(22) Filed: Jul. 27, 2009

(65) Prior Publication Data

US 2011/0018778 A1 Jan. 27, 2011

(51) Int. Cl.
*H01Q 9/16* (2006.01)

(52) U.S. Cl.
USPC ..... 343/793; 343/801

(58) Field of Classification Search ..... 343/793, 343/795, 801, 876
See application file for complete search history.

(56) References Cited

U.S. PATENT DOCUMENTS

| | | | | |
|---|---|---|---|---|
| 6,822,394 | B2 | 11/2004 | Staines | |
| 7,002,300 | B2 | 2/2006 | Staines | |
| 7,042,415 | B2 * | 5/2006 | Cheng | 343/795 |
| 7,215,083 | B2 | 5/2007 | Staines | |
| 2006/0290586 | A1 * | 12/2006 | Lee et al. | 343/801 |

* cited by examiner

*Primary Examiner* — Tan Ho
(74) *Attorney, Agent, or Firm* — David Allen Hall

(57) ABSTRACT

An integrated resonator and dipole for generation of high power directional RF energy.

20 Claims, 19 Drawing Sheets

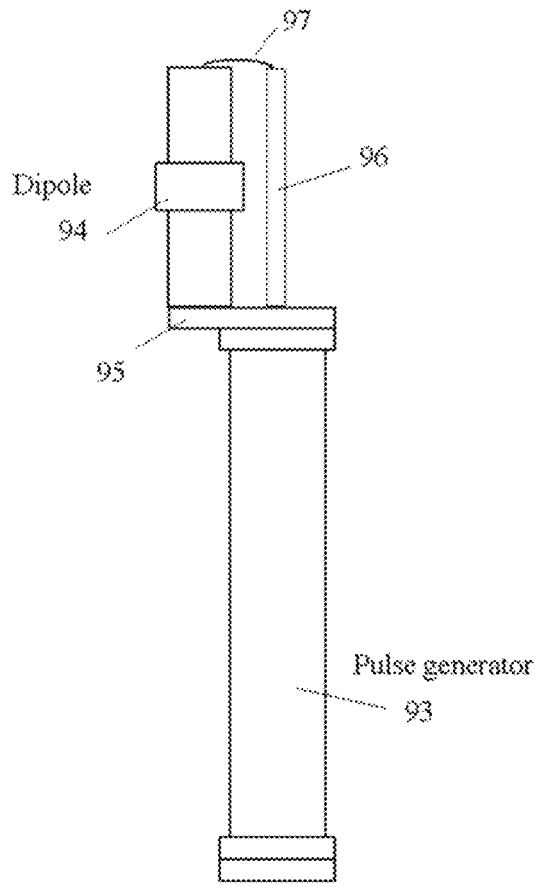
Figure 26 Dipole mounted directly to Marx
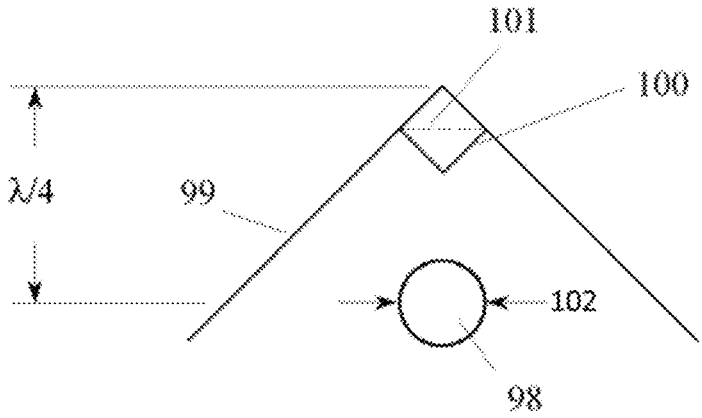
Figure 27

INTEGRATED RESONATOR AND DIPOLE FOR RADIATION OF HIGH POWER RF ENERGY

FIELD OF THE INVENTION

The present invention pertains to the field of high power RF, more specifically with high powered dipole structures, and is an improvement over existing fat dipole geometries.

BACKGROUND OF THE INVENTION

The dipole antenna is the most fundamental and simple radiating structure, and appears in many physical applications. The basic structure in FIG. 1 is comprised of two collinear wires 1 extending away from each other, sourced by some transient or resonant electrical source 2. The lengths of the wires, which are the arms of the dipoles, are related to the desired radiating frequency. The two-wire structure is well suited for continuous wave applications, or low voltage, low power applications, due to its relatively high impedance geometry of approximately 150 Ohms.

High power radiation is desired for many applications, including electronic disruption. High powers can be achieved from a fat dipole structure, illustrated in FIG. 2, because the larger diameter arms 3 produce high capacitance that decreases the impedance of the structure to tens of Ohms. The application of high voltage resonant energy 4 onto the low impedance structure can generate very high currents that result in large electric field strengths.

Generating high voltage resonant energy and efficiently delivering it onto the dipole structure can be very difficult, since high voltage connections are typically large and result in impedance mismatches with the source. This problem can be mitigated by integrating the resonant source within the dipole geometry.

A number of efforts have been made to radiate high powered RF from dipole antennas. The most common geometry has been with a resonant quarter wave transmission line built into a dipole geometry. Staines describes this method through several patents (U.S. Pat. Nos. 7,215,083 B2, 6,822,394 B2, 7,002,300 B2).

The Staines geometry is essentially a sleeve dipole designed for a specific radiation frequency, and uniquely integrates a switched resonant quarter wave, low impedance transmission line into the dipole geometry, as illustrated in FIG. 3. The Staines device is comprised of a center conductor 5 contained within an outer conductor 6, but electrically insulted by a gas medium. The transmission line section 7 is charged to a high voltage. The switch 8, which is typically a spark gap, closes, causing a resonance to set up on the transmission line, the resonance being related to the length of the complete structure. The center conductor 5 of the transmission line extends beyond the ground section 6 for a distance of a quarter wavelength, such that the length of the complete device is one half wavelength, making the device a half wavelength radiator. The extended center conductor section refers back to the outer conductor in a manner similar to a traditional dipole.

The fat dipole of FIG. 2 has many advantages over the traditional thin wire geometry. The thin wire geometry is characterized by a relatively high impedance, approximately 150Ω, which reduces the current of the device, and thereby reduces the radiated electric field. Conversely, the fat dipole has lower impedance (tens of Ohms), which allows for higher currents in the antenna, resulting in increased radiated electric fields. The thin wire geometry is also a high Q device, requiring well-tuned driver sources 2. The fat dipole is a wider band device, allowing it to be driven by sources 4 that do not exactly match it in frequency and geometry. Lee (U.S. Pat. No. 7,321,341 B2) presents a dipole geometry designed for wideband operation. Lee's geometry uses multiple wires for each dipole arm, with each wire varying in length. As a result, multiple frequencies are simultaneously radiated.

The standard fat dipole has some shortcomings, primarily its signal gain, or radiation efficiency. FIG. 4 illustrates a fat dipole with an external source. The preferred current path 8 is vertical; however, additional current paths 9 propagate through the device, each characterized by a unique path length or wavelength. These additional currents subtract from the total current flow and decrease the radiated electric field, since they do not contribute to the desired radiation frequency. Fat dipole geometries with integrated resonators, as with the Staines geometry, suffer from the same problem. Because the Staines device employs a single switch with a large bodied structure, many current modes result as charge propagates through the line. Staines seems to have somewhat decreased this effect by making his center conductor conical near the switch.

The application of high voltage to a dipole can be made in a wide variety of methods, but is summarily reduced to two basic geometries: 1) a direct connection, and 2) connection via high voltage coaxial cable. High voltage may also be delivered via direct current for a constant voltage, or via pulse charging methods. The pulse charging method can result in much higher radiated electric field strengths if the pulse rise-time is shorter than that of the corresponding center frequency of the antenna, so that much higher voltages can be placed on the capacitor before the spark gap closes.

SUMMARY OF THE INVENTION

The present invention uniquely integrates a simple high voltage resonator with a multi-rod dipole arm geometry to produce high power RF radiation. The radiated frequencies of the preferred embodiment extend to hundreds of MHz. Operation of the present invention may be extended to higher frequencies. But at higher frequencies the smaller resonator geometries limit high power operation, and very fast switches must be used. The simple high voltage resonator naturally conforms to the dipole geometry, with a parallel plate geometry providing the primary capacitance, and the dipole's arms providing the secondary capacitance. The parallel plate structure incorporates a centrally-located spark gap that provides the necessary inductance for completion of the resonance condition. A simple LC circuit is realized. The wavelength of the LC circuit should be matched to the round-trip path length of the dipole device.

The dipole structure is implemented as a fat dipole, with arms several inches in diameter and designed to decrease the dipole's impedance via the increased capacitance provided by the increased surface area, thus allowing increased surface current. For this invention, the arms are made of several small, parallel rods placed within the plate perimeter with regular spacing. Each rod simulates the fat dipole geometry, and mitigates unwanted transverse current modes that do not propagate strictly up and down, i.e. along an antenna axis, on the arm structure.

Furthermore, the multiple parallel arms are connected directly to each plate of the resonator, so that outer edges of the individual rods align with the plate edge perimeter so that no conductive shoulder results. This implementation minimizes current path lengths and avoids added inductance that reduces efficiency. Furthermore, an annular end plate terminates the rods and enhances the magnitude of the radiating electric field.

The primary advantage of the present invention is the integration of a simple parallel plate resonator within a multi-rod dipole antenna geometry that provides higher voltage radiation efficiency that can result in very high radiated electric field strengths.

BRIEF DESCRIPTION OF THE DRAWINGS

FIG. 26. A pulse generator connected directly to the dipole.

FIG. 27. A corner reflector, containing a centered inverted second corner reflector, backing the dipole antenna.

DETAILED DESCRIPTION OF THE PREFERRED EMBODIMENT

Terminology used herein describes particular embodiments only, and is not intended to be limiting. As used in the specification, including the claims, the singular forms "a", "an", and "the" include singular and plural referents unless the content dictates otherwise. Unless defined otherwise, all technical and scientific terms used herein have meanings commonly understood by one of ordinary skill in the relevant art or industry.

Figure 1:
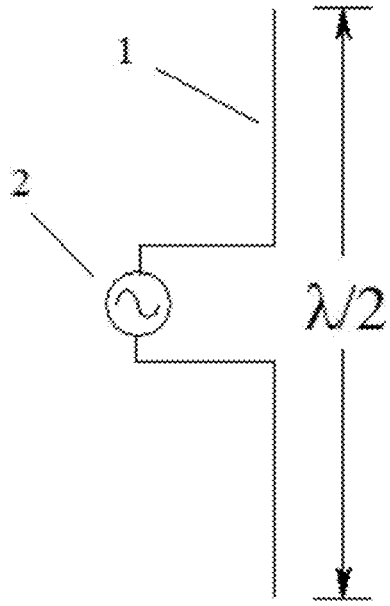
FIG. 1. Basic dipole geometry.
Figure 2:
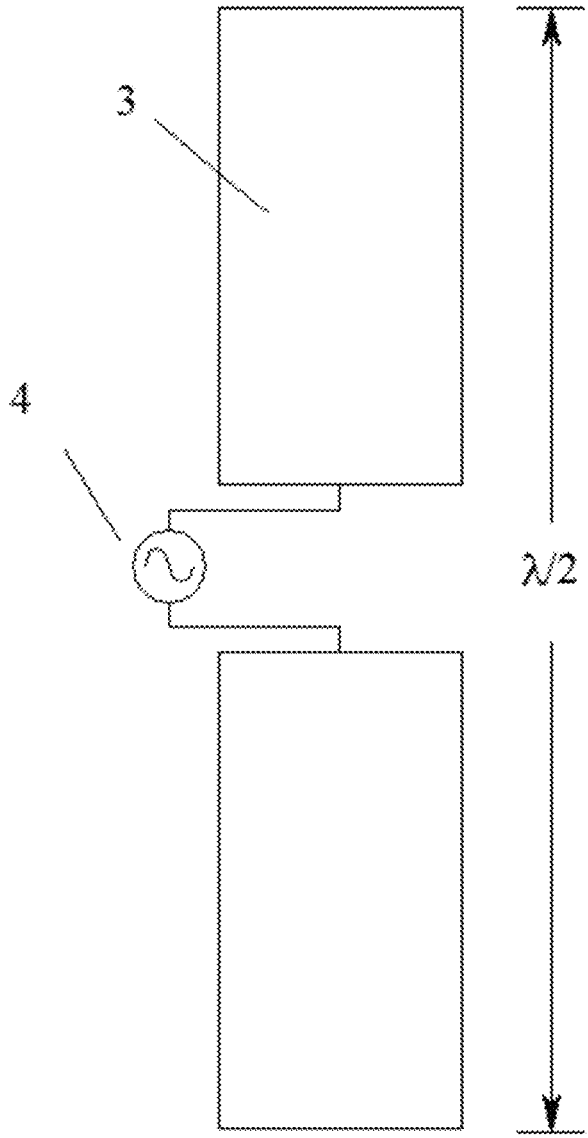
FIG. 2. A traditional fat dipole structure.
Figure 3:
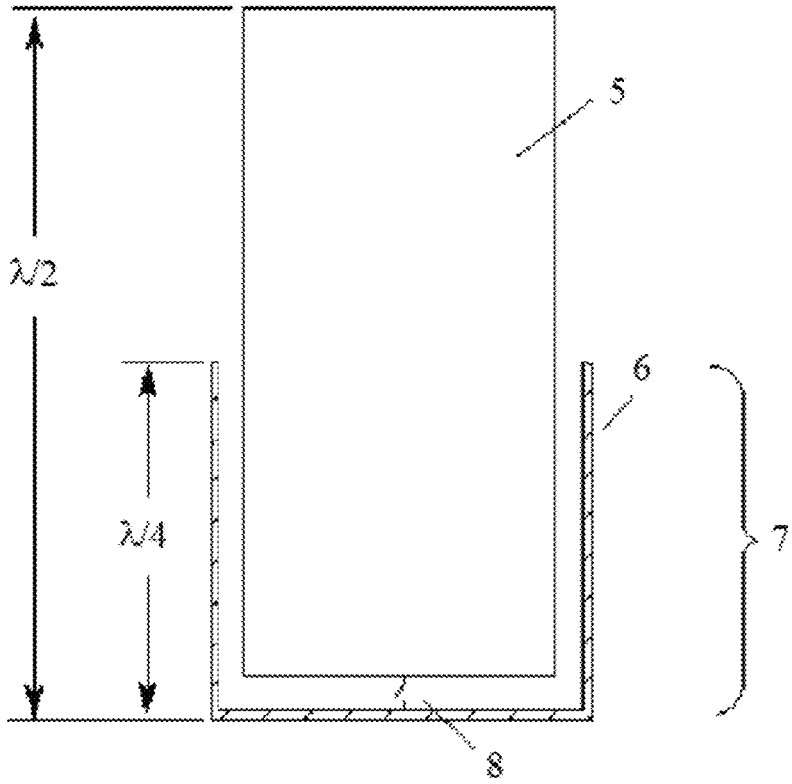
FIG. 3. An integrated transmission line resonator-based dipole similar to the Staines device.
Figure 4:
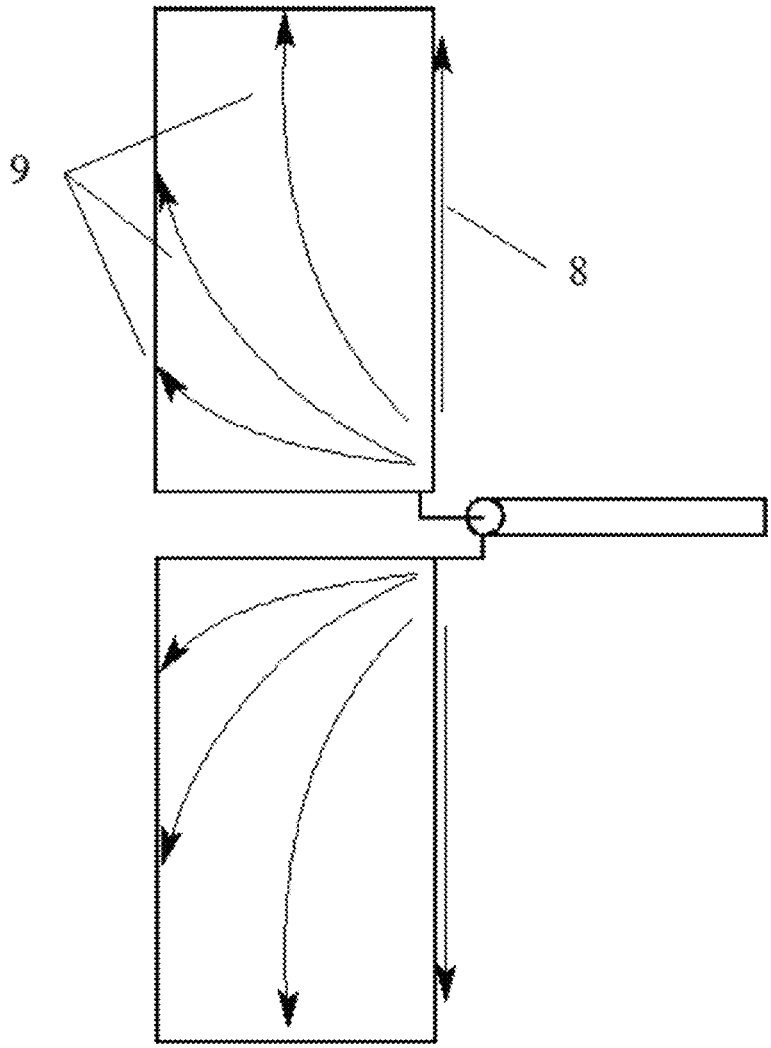
FIG. 4. Current propagation on a fat dipole device.
Figure 5:
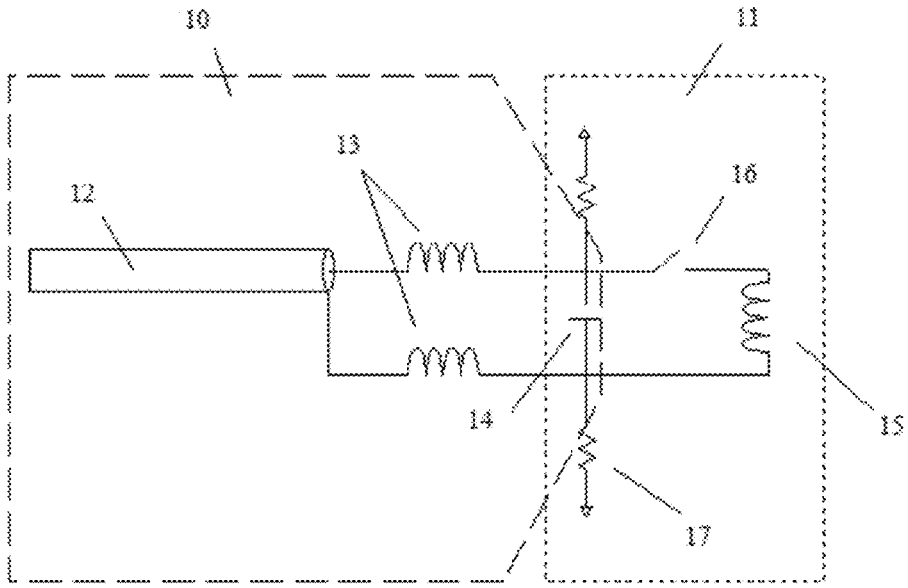
FIG. 5. A circuit diagram of the charge and resonant circuits used to describe the operation of a high voltage dipole device.

The simplified circuit of FIG. 5 electrically describes the charge and discharge of a dipole with an integrated LC oscillator. For convenience, the circuit is described in two parts: the charging circuit 10, and the resonant and load circuit 11. The charging circuit 10 is comprised of a high voltage cable 12, and two inductors 13 designed as charging elements that provide the necessary isolation between circuits 10 and 11. The capacitor 14 serves both circuits.

The resonator circuit 11 is simply comprised of the common capacitor 14, an inductor 15, and a switch 16. Once the capacitor 14 has been charged, the switch 16 is closed, resulting in resonance between the capacitor 14 and the inductor 15. The resonant frequency is defined by $$f = \frac{1}{2\pi}\frac{1}{\sqrt{LC}}.$$

The switch 16 can be a triggered switch, but the preferred switch 16 is comprised of an over-voltage spark gap switch, since extreme voltages are desired. Furthermore, a self break switch is preferred for better isolation between the resonant circuit 11 and the charging circuit 10, since a triggered switch can create unwanted ground references. The resistors 17 load the resonant circuit 10, bleeding the energy from the circuit. Here the resistors 17 represent the radiation resistance of the dipole arms.

The primary function of the charge circuit 10 is delivery of energy onto the capacitor 14 as quickly as possible (i.e switch closure time shorter than rise time associated with center frequency) and with maximal voltage before the switch 16 closes. A high voltage pulse is delivered via a section of high voltage cable 12, which is isolated from the resonant circuit 11 via the connection inductance provided by the two inductors 13. The connection inductance is necessary for the isolation of the dipole from the cable 12 when the switch 16 closes. Without this isolation the cable 16 may load the resonant circuit thereby diminishing the radiated field.

Figure 6:
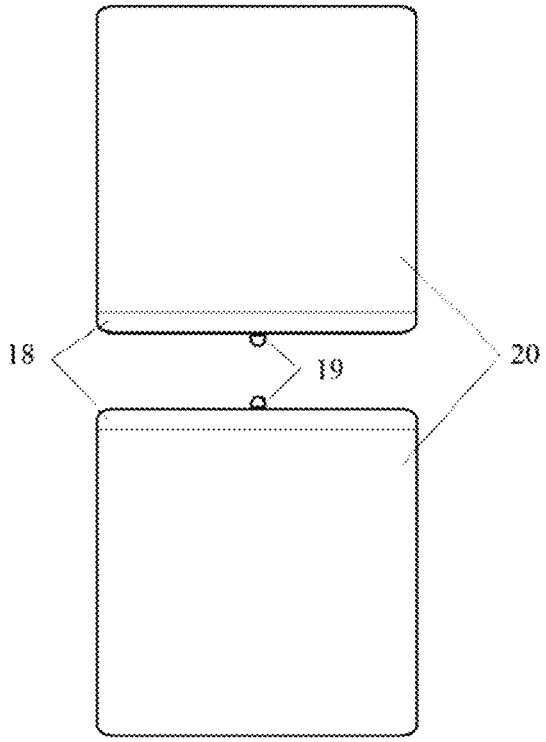
FIG. 6. A fat dipole device with an integrated simple resonator.

The basis of this invention is the integration of a simple resonator into the dipole stricture. The simple resonator of FIG. 6 is comprised of two parallel plates 18 mounted at the ends of the fat dipole arms 20, and a centered spark gap switch 19. The plates 18 can be fabricated from any conductive material, but aluminum or brass is preferred. The plates 18 are typically disc-shaped, with rounded edges. The spark gap electrodes should be machined in hemispherical shapes and can also be fabricated from any conductive material; however, brass is preferred.

Figure 7:
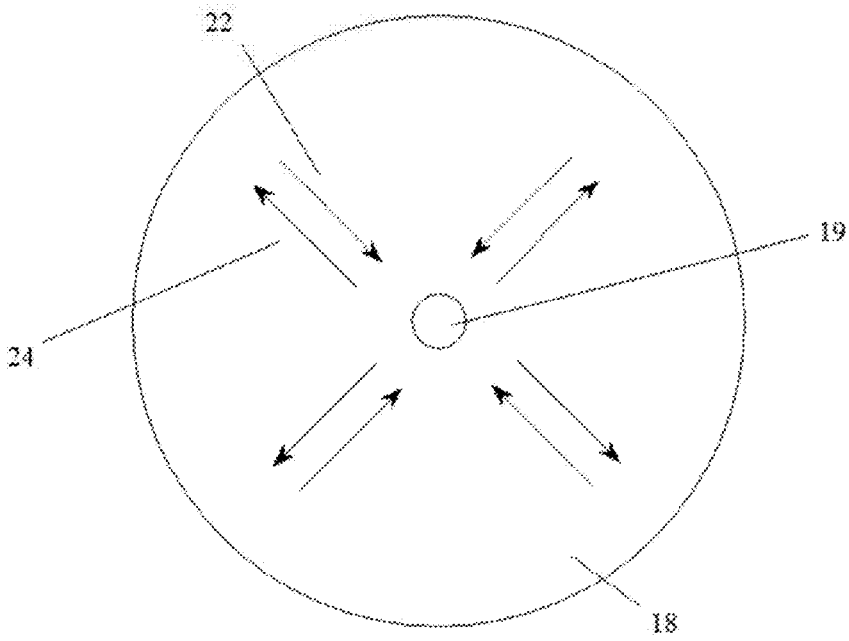
FIG. 7. An end view of a fat dipole device with an integrated simple resonator, illustrating the correct current propagation in the axial direction as a result of a centered spark gap switch.
Figure 8:
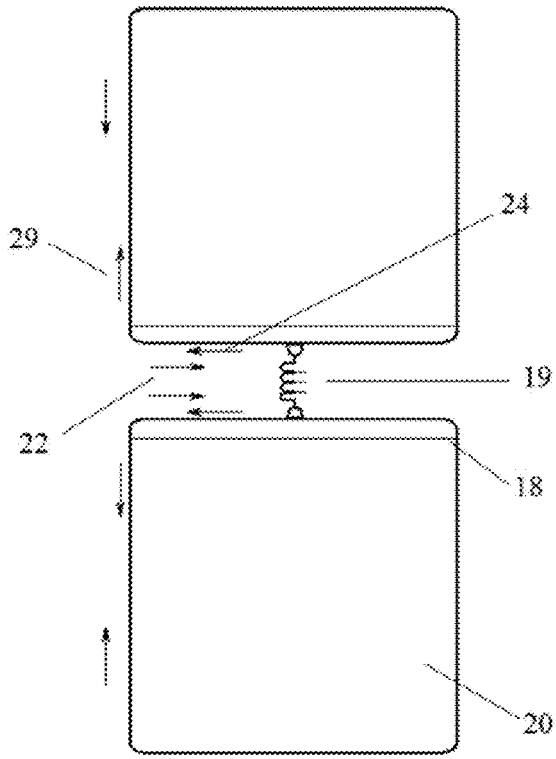
FIG. 8. A side view of the fat dipole device illustrating current propagation along the structure.

The spark gap switch 19 should be centered within the plate geometry so that current always flows in the radial direction, as illustrated in FIG. 7. As energy moves from the inductor (i.e. the inductance of the spark), the current 24 moves radially outward, filling the plates 18 with charge. Conversely, as energy moves from the capacitor's plate 18, current 22 moves radially inward toward the inductor (i.e. the inductance of the spark), or spark gap. An expanded view is shown in FIG. 8, illustrating the current dynamics on the complete structure. As energy moves out of the inductor 19, the charge 24 propagates outward, filling the plate 18. Charge 29 also propagates through the dipole arms 20, moving away from the plates to the end of the arms. Once the structure has filled, charge returns to the inductor 19. Current 22 reverses on the arms, propagating from the end of the arms 20 toward the plates 18, and radially inward on the plates toward the inductor 19.

Figure 9:
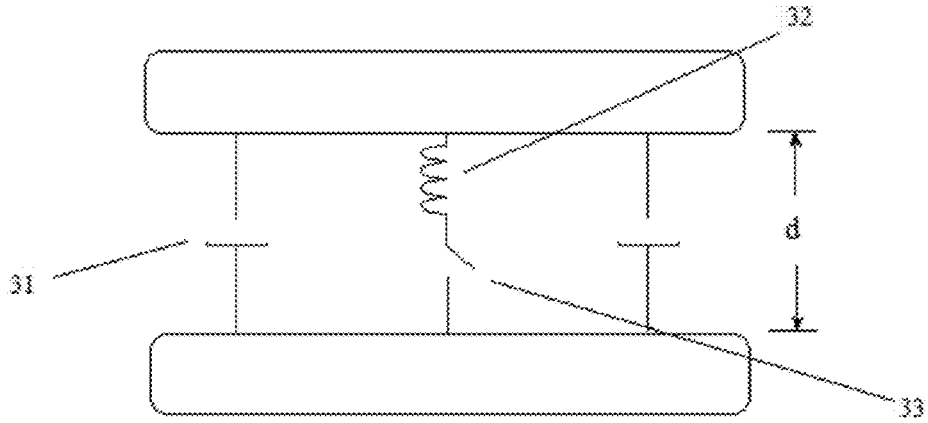
FIG. 9. Fundamental electrical parameters of a parallel plate spark gap switch.

The resonator model of FIG. 9 illustrates the basic elements of the resonator, and includes the capacitance 31 defined by the parallel plates, the inductance 32 defined by the spark gap switch, and a simple switch 33. The capacitance 31 is primarily defined by the parallel plate structure, but is aided by the stray capacitance due to the fat dipole arms. The parallel plate capacitance 31 is defined as $$C = \frac{\varepsilon_r \varepsilon_0 A}{d},$$

where $\in_0$ is the permittivity of free space, $\in_r$ is the relative permittivity of the dielectric material between the plates, A is the area of the parallel plates, and d is the distance between the plates. The spark gap inductance is a function of the electrode separation, and contributes to the definition of the plasma channel properties.

The resonant frequency of the simple resonator should match the wavelength of the dipole. The typical dipole geometry is a half wavelength structure, which makes each arm a quarter wavelength.

A variety of insulating dielectric materials can be used between the plates, including vacuum, gases (e.g. dry breathable air, hydrogen and sulfurhexaflouride), liquids (e.g. deionized water, flourinert or transformer oil), or solids (e.g. plastics, epoxy, or a ceramic). The insulating method has considerable effect on both the capacitance and the inductance of the circuit, and affects service and switch design considerations.

Figure 10:
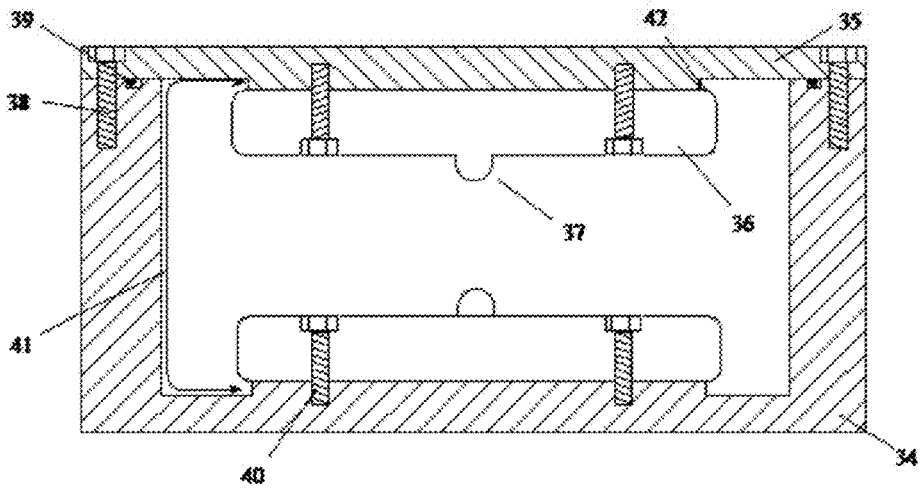
FIG. 10. A containment structure encapsulating the parallel plate device.

Vacuum, gas, and liquid insulation methods employ similar geometries. A structure must be designed to provide both mechanical fixturing of the dipole and containment of the insulating medium. A preferred structure, illustrated in FIG. 10, is comprised of a bowl-like vessel 34, a coverplate 35, two capacitor plates 36, and the spark gap electrodes 37. The vessel 34 and coverplate 35 should be made with a plastic material. The coverplate 35 is fastened to the vessel 34 with bolts 38, which are preferentially plastic. An O-ring 39 ensures a good seal.

One of the capacitor plates 36 is mounted to the vessel 34, and the second plate 36 is mounted to the coverplate 35. The plates 36 are held to their respective surfaces with bolts 40, countersunk to be flush with the plate surface. The bolts should not protrude through the vessel walls. The spark gap electrodes 37 can be made with bolts that are screwed through the plate, making them adjustable. However, seals must be included to prevent leaking.

The path 41 between the two plates 36 and along the plastic surface should be long enough to prevent an electrical discharge or surface flashover. The inside diameter of the vessel should be larger than the capacitor plates, and the depth of the vessel should be larger than the total of the two plate thicknesses and the plate separation. Additionally, vaulting the plates above the vessel surface 42 mitigates the propagation of charge along the plastic surface.

Figure 11:
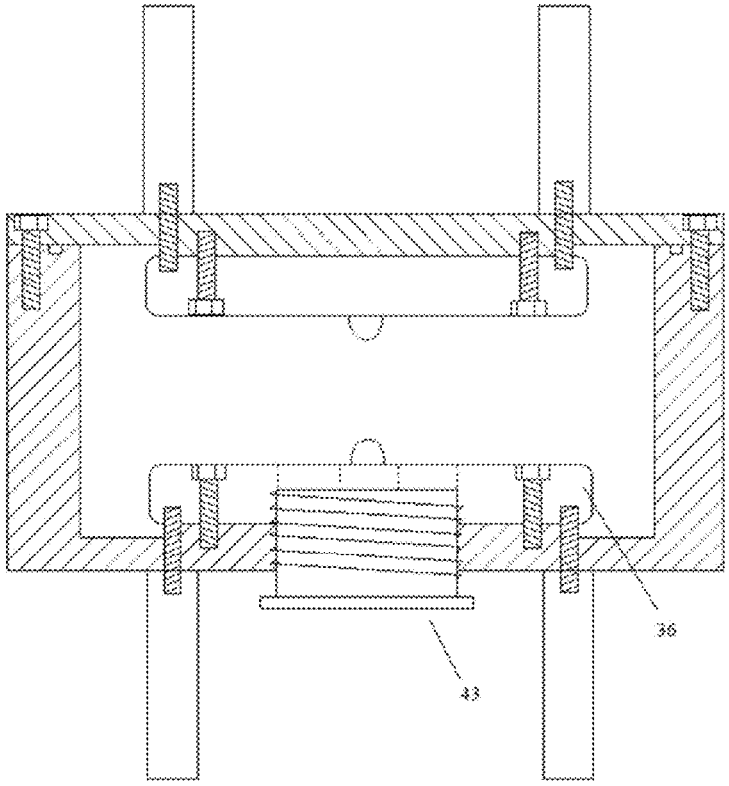
FIG. 11. The evacuated containment structure.
Figure 12:
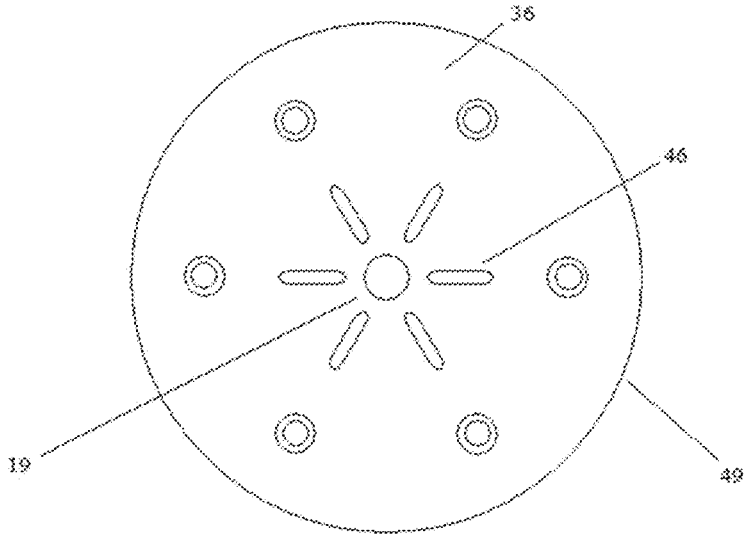
FIG. 12. An end view of the parallel plate illustrating thin slots used for evacuating the containment structure.

In the case of vacuum as the insulating material, a vacuum port should be integrated into the chamber. A simple air fitting can be used, since the volume is relatively small. However, a vacuum port is preferred, as shown in FIG. 11. The preferred orientation of the vacuum port 43 is concentric to the dipole and behind one of the capacitor plates 36. To minimize capacitance loss and current disruption, small radial vents 46 can be cut into the capacitor plate 36, extending away from the spark gap switch 19 and toward the edge 49, as illustrated in FIG. 12. A vacuum pump should be located near the dipole.

Figure 13:
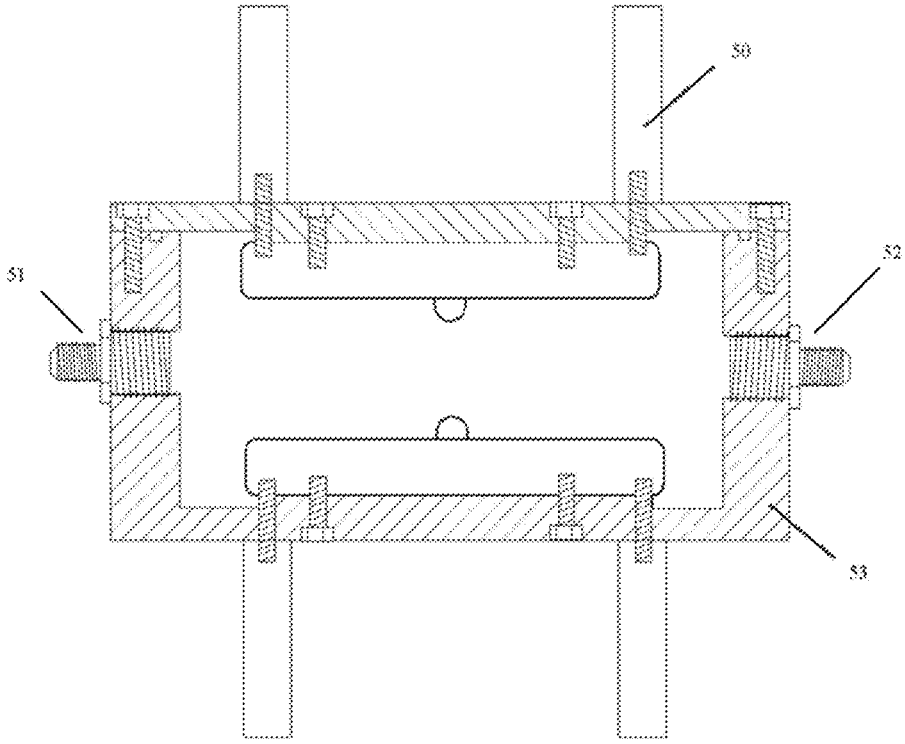
FIG. 13. A containment vessel that can be pressurized with a gas or filled with a liquid.

Gas insulated geometries are the easiest to implement. An example containment vessel is illustrated in FIG. 13, with the parallel plate structure fully contained within the vessel, and the dipole arms 50 protruding through the ends of the vessel. An air source 51 and a bleed port 52 can easily be fed through the wall 53 of the vessel. An external pressurized gas source is required.

Liquid insulated geometries should be identical to the gas geometries. However, the entry 51 and exit ports 52 should be larger, with approximately ½" diameter tubing providing the conduits. High flow rates may be required for higher repetition rates, since a spark in the fluid results in carbon residues, which can adversely affect the performance of the dipole with self breakdown conditions and sparks forming in inappropriate locations.

Figure 14:
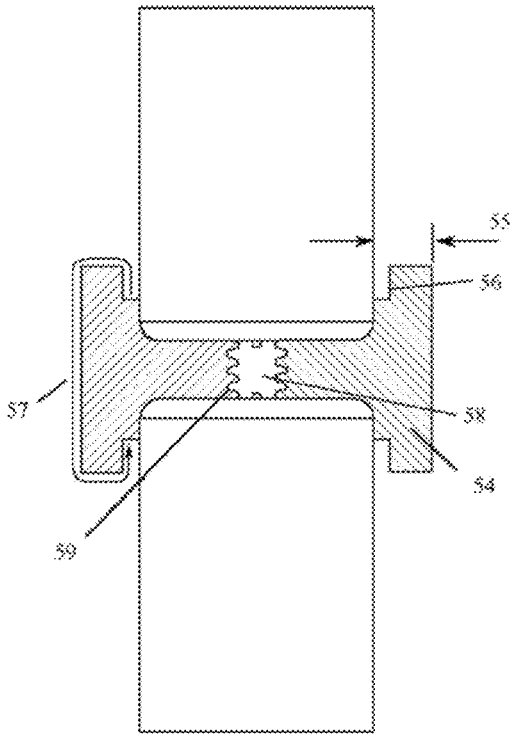
FIG. 14. A solid insulation dipole device.

Solid material geometries are the most difficult to implement, but might be desirable for applications requiring compactness, especially for lower frequencies requiring large capacitances. It should be obvious that the spark gap switch must have a vacuum, gas, or liquid medium; otherwise the switch would be a single event component, since the dielectric medium would be damaged. Flashover conditions must be avoided, since carbon traces are left on the dielectric surface and lead to subsequent flashovers at lower potentials. A sample geometry for a solid medium is illustrated in FIG. 14. The dielectric medium 54 should extend beyond the plates some distance 55 and wrap around beyond the top of the plates 56. As a result, a very long path 57 is established from plate-to-plate in the open air region. Near the center of the device, a closed volume 58 should be filled with a gas or liquid, or evacuated with a pump. A long path should be made along the interface, with the preferred geometry including grading rings 59.

Figure 15:
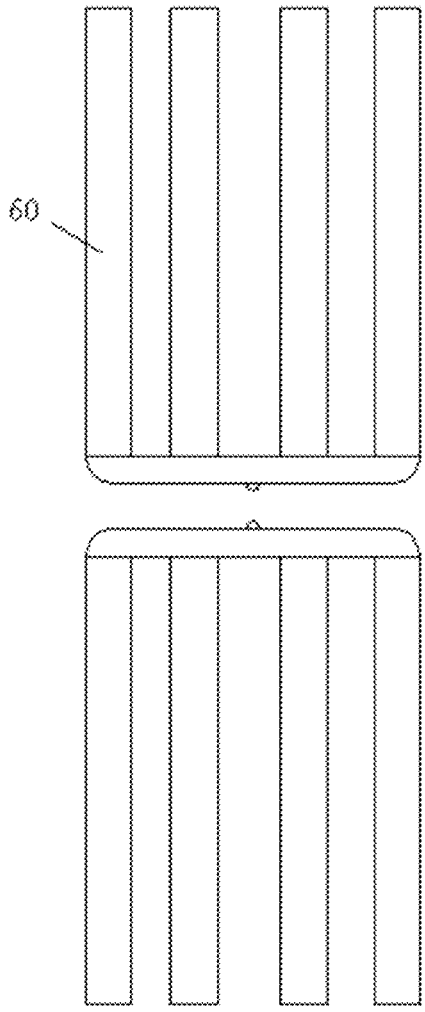
FIG. 15. A side view of a rod array replacing the typical single fat dipole arm.
Figure 16:
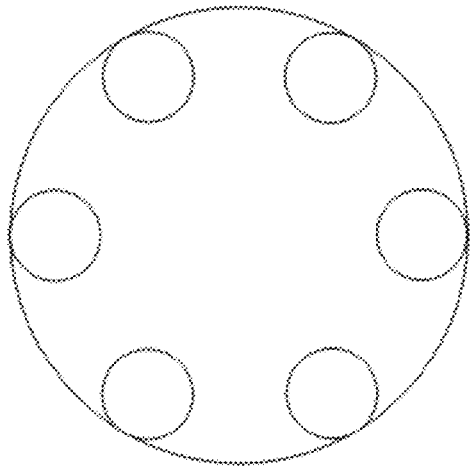
FIG. 16. An end view of the rod geometry.

The typical fat dipole arm geometry is described by FIG. 8. In this invention, the typical single cylindrical geometry is replaced with a multi-rod geometry, illustrated in FIG. 15, for mitigation of the formation of multiple current modes. There should be a sufficient number of rods to closely approximate the traditional cylinder; however, the rods 60 should not touch each other, so as to maintain conductive isolation. There should also be enough separation to minimize the capacitive coupling between the rods. To minimize the weight of the arms, thin wall tubes can be used. FIG. 16 provides a top view of the rod geometry.

Figure 17:
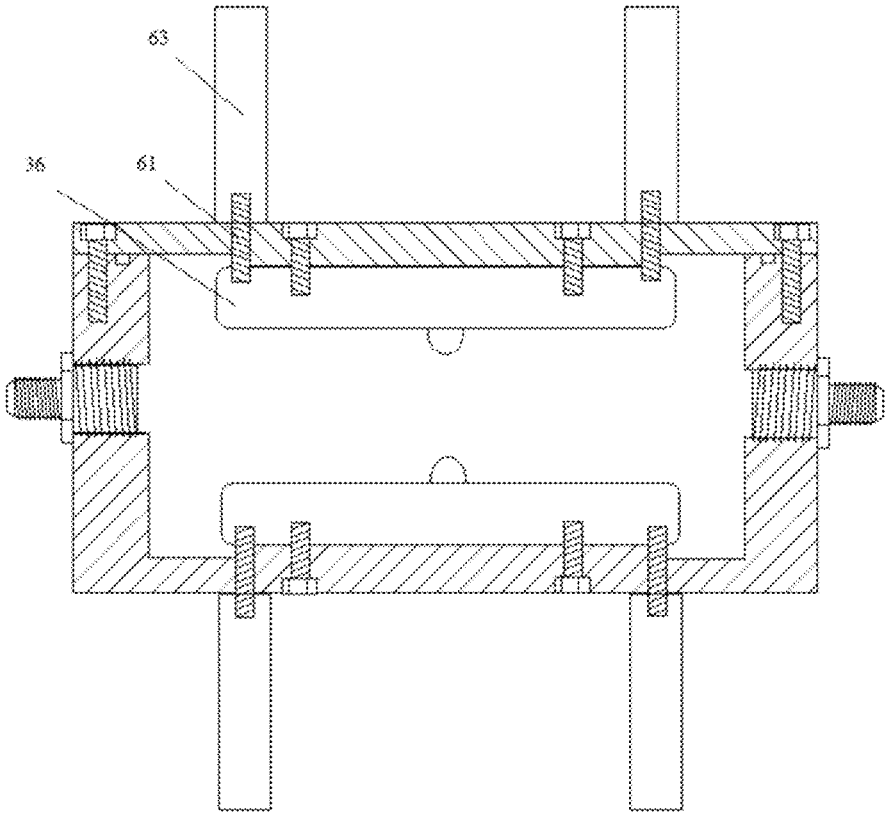
FIG. 17. Indirect connection of the rods to the capacitor plate.

The rods (or tubes) can be connected to the plates via threaded rods 61 penetrating the containment vessel, as illustrated in FIG. 17. While not efficient, this method provides a suitable electrical connection. The plates 36 and the rods 63 are connected with all-thread 61. Pressure can be maintained with O-rings, gaskets, or seals.

Figure 18:
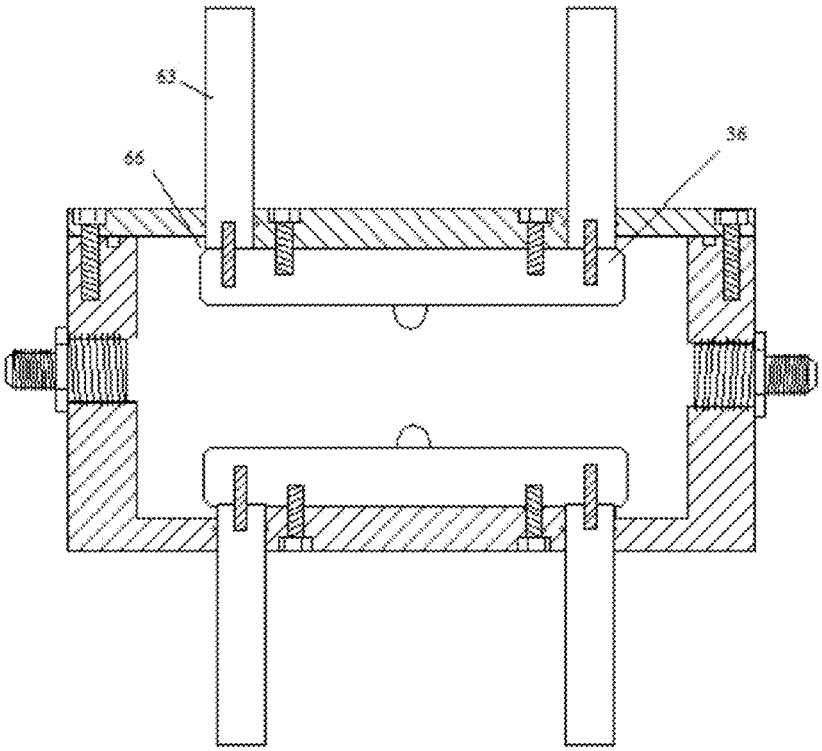
FIG. 18. Direct connection of the rods to the capacitor plate.

FIG. 18 illustrates that the preferred method for connecting the rods (or tubes) 63 to the plates 36 is with direct contact, and near the plate's edge 66, so that the charge moves directly onto the rods from the plate and in the orthogonal direction without excessive bends or propagation perpendicular to the rods. Any path not orthogonal to the plate, or along the direction of the rod, results in inefficiencies and lower radiated electric field strengths.

Figure 19:
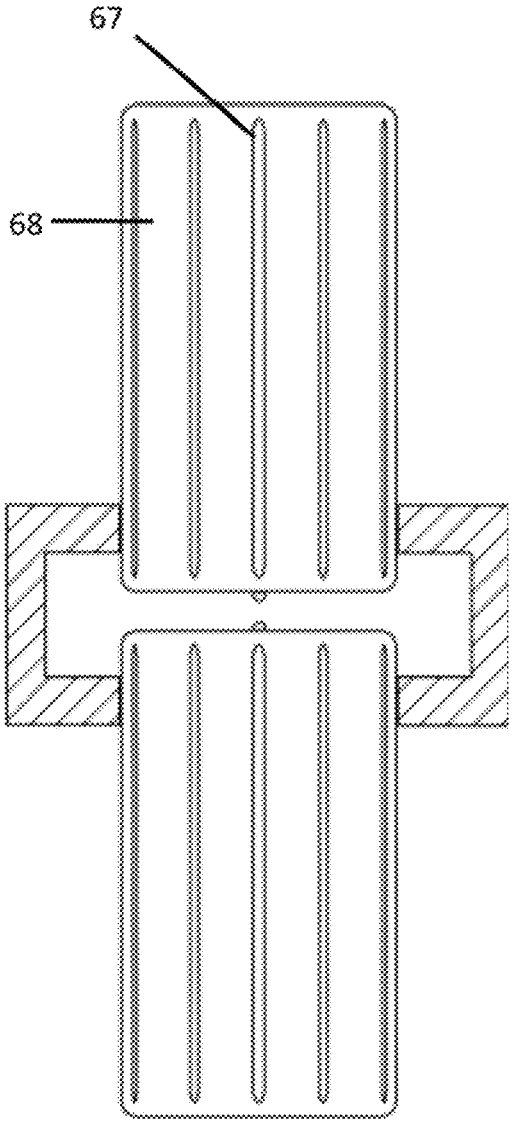
FIG. 19. Slotted tube alternative to solid rod geometry.

The arms of the fat dipole can alternatively be implemented with slotted tubes as illustrated in FIG. 19. Thin slots 67 are cut into the conductive tube 68 and should extend longitudinally close to each end of the tube 68. The slots 67 are made to mitigate non-longitudinal current paths, and several should be made, for example, every 45 degrees around the circumference of the tube 68.

Figure 20:
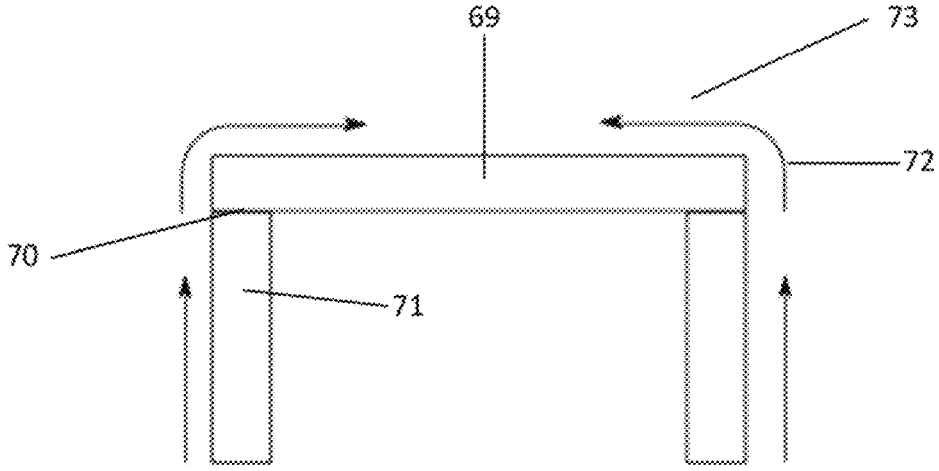
FIG. 20. A solid disc capping the rods.

The ends of the dipole arms can be left open; however, attaching circular discs will enhance the electric field. Solid discs 69, as described by FIG. 20, should be directly bolted 70 to the ends of the rods 71. It is noted, however, some energy is lost as charge propagates along the top 72 of the disc and continues orthogonal 73 to the direction of the rods 71 to the center of the disc 69. It is further noted that this added path length shifts operating frequency downward.

Figure 21:
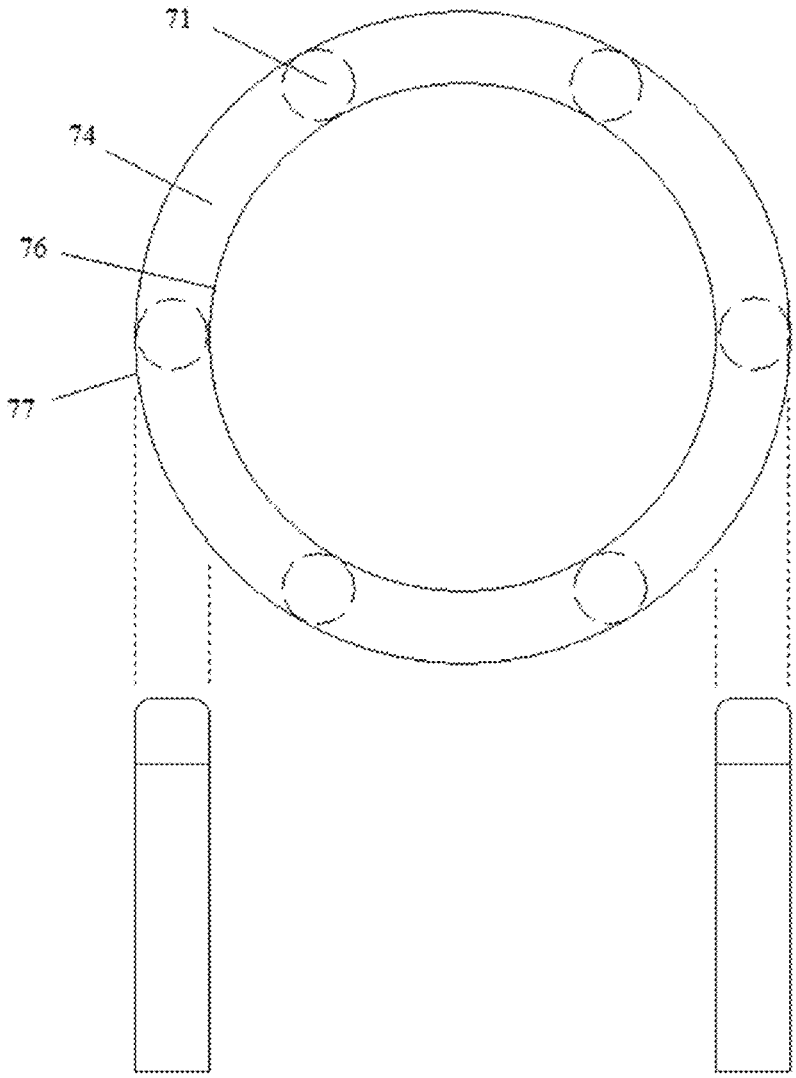
FIG. 21. An annular disc capping the rods.

Annular discs are preferred, as illustrated in FIG. 21, to mitigate the orthogonal current flow. The preferred geometry bolts an annular disc 74 to the end of the rods 71. The inner diameter 76 of the disc 74 should just inscribe the diameter suggested by the innermost edge 76 of the rods. The outside diameter of the annular disc 74 should just capture the diameter suggested by the outside edge 77 of the rods.

Figure 22:
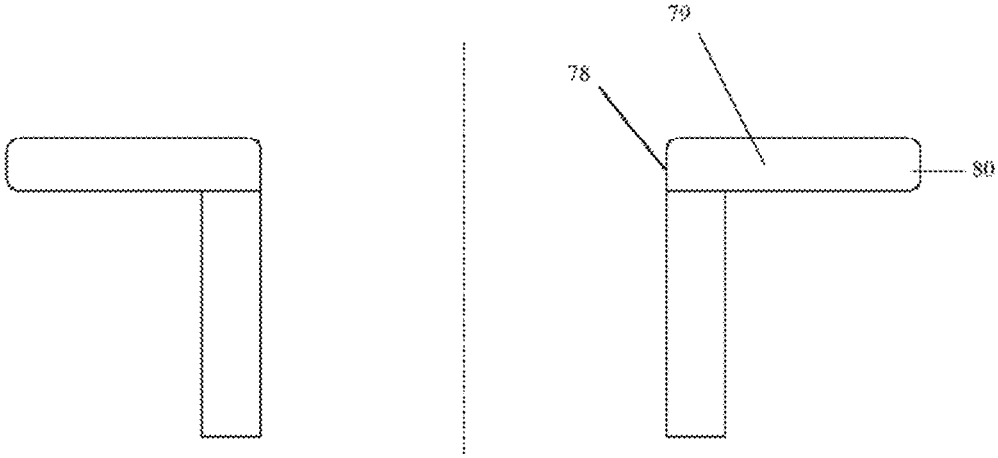
FIG. 22. Oversized annular discs.
Figure 23:
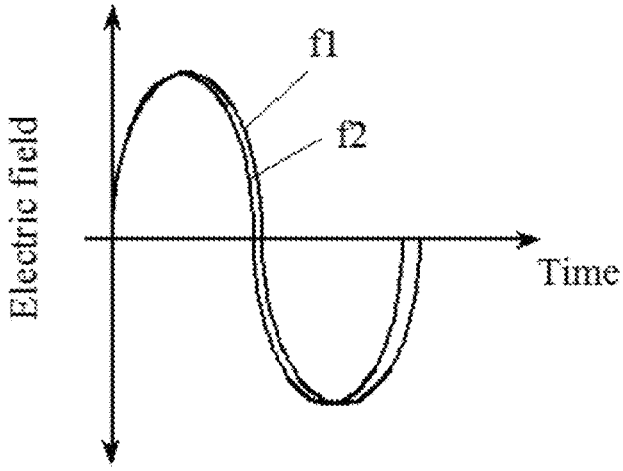
FIG. 23. Frequency change due to the increased diameter of the annular discs.

Increasing the outer diameter of the annular disc can result in lowered radiated frequencies, with a frequency change directly related to the change in the diameter. As illustrated in FIG. 22, the inner diameter 78 of the annular disc 79 should remain constant; however, the outer diameter 80 can be changed, as practical. FIG. 23 illustrates the change in the radiated electric field with a small change in the outside diameter of the annulus.

Figure 24:
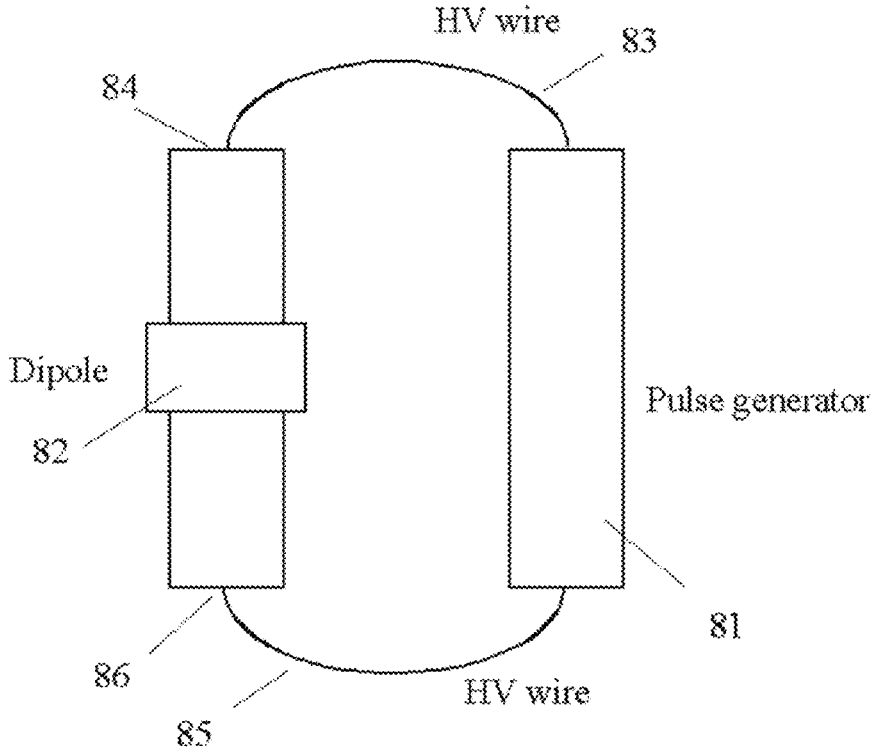
FIG. 24. The direct connection of an unshielded pulse generator to the dipole.

The preferred driver or source for the dipole is an unhoused pulse generator, as illustrated in FIG. 24. The pulse generator 81 is located in close proximity to the dipole 82. High voltage wire 83 connects the high voltage output of the pulse generator 81 to the top of the dipole 84, and a second high voltage wire 85 connects the ground reference of the pulse generator 81 to the bottom of the dipole 86. The orientation of the connection or the polarity of the pulse generator is not important. The most important consideration is prevention of voltage breakdown other than the spark gap switch closure.

If the capacitance of the pulse generator is substantially greater than the capacitance of the dipole, a resonant charge may occur, resulting in twice the voltage of the pulse generator across the dipole. The final charge magnitude, however, is largely dictated by the characteristics of the spark gap.

Figure 25:
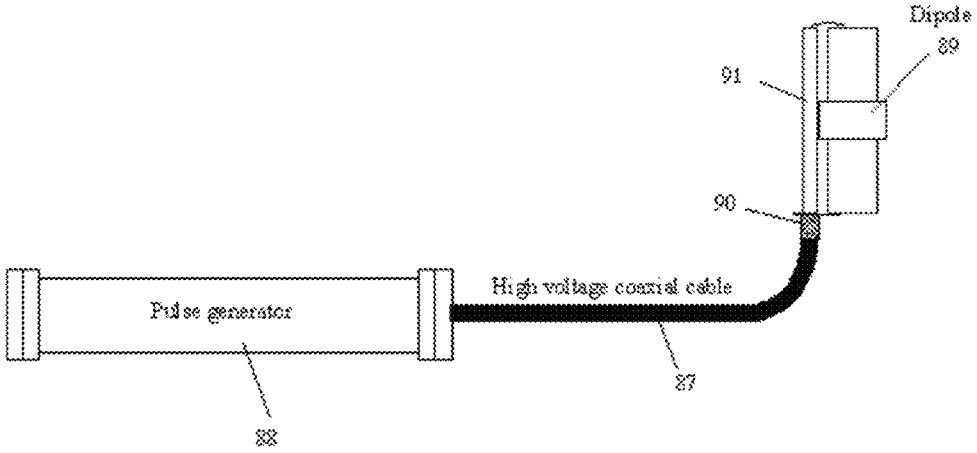
FIG. 25. A pulse generator connected to the dipole via high voltage coaxial cable.

A second preferred method for charging the dipole with high voltage is via coaxial cable, illustrated in FIG. 25. The high voltage coaxial cable 87 is driven by a pulse generator 88 and terminates at the dipole 89. The braid 90 (ground connection) of the coaxial cable 87 stops at one end of the dipole 89, and the insulated center conductor 91 of the coaxial cable 87 continues and connects to the opposite end of the dipole 89. The insulated center conductor 91 closely parallels the body of the dipole 89 for minimization of connection inductance. A housed pulse generator is preferred so as to better source a 50 Ohm coaxial cable.

A shielded or conductively housed pulse generator can be directly connected to the dipole, but should not continue the dipole arm geometry exactly. The preferred geometry, illustrated in FIG. 26, directly attaches the pulse generator 93 to the dipole 94 that shares a common endplate 95. An unshielded conductor 96 extends from the pulse generator and connects to the opposite endplate 97 of the dipole to complete the circuit.

The electric field generated by the dipole can be directed in a forward direction with a backing reflector. While the primary use of the reflector is narrowing of the torroidal beam to a width in the tens of degrees, the reflector can also increase the electric field of the first half cycle via capacitive coupling, and can also increase the number of cycles in the radiated damped sinusoidal temporal response. One problem associated with the reflector-backed dipole is beam blocking caused by the large diameter dipole. The dipole radiates some amount of energy toward the reflector. The majority of the energy reflects to propagate forward, but some of the energy is blocked by the dipole, and is seen as loss. This invention modifies the reflector to include an inverted reflector so that energy that would normally be blocked by the dipole is instead deflected back into the reflector, but away from the center. The radiated electric field can be increased 10-20% as a result of this design.

Figure 28:
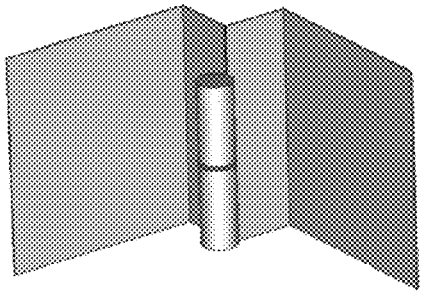
FIG. 28. An isometric view of a corner reflector, with a centered inverted corner reflector, backing the dipole antenna.

The preferred embodiment of FIG. 27 illustrates the dipole 98, a 90 degree corner reflector 99 and an inverted 90 degree corner reflector 100. The dipole 98 is located approximately a quarter wavelength from the reflector 99. The inverted corner reflector 100 is centered with the primary reflector 99, and is equal in its hypotenuse 101 to the diameter of the dipole's arm diameter 102. FIG. 28 provides an isometric view.

It will be apparent to those with ordinary skill in the relevant art having the benefit of this disclosure that the present invention provides an apparatus for generation of high power RF energy. It is understood that the forms of the invention shown and described in the detailed description and the drawings are to be taken merely as the currently preferred embodiments, and that the invention is limited only by the language of the claims. The drawings and detailed description presented herein are not intended to limit the invention to the particular embodiments disclosed.

Figure 29:
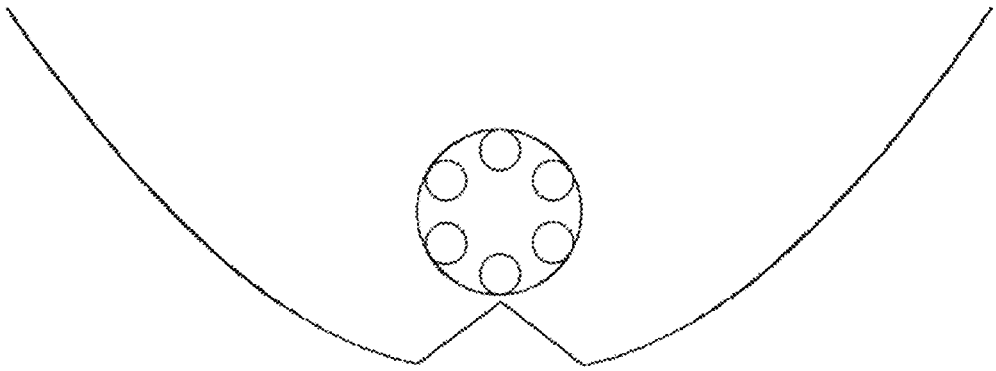
FIG. 29. A top view of a parabolic reflector, with a centered inverted parabolic reflector, backing the dipole antenna.

While the present invention has been described in terms of two preferred embodiments, it will be apparent to those skilled in the art that form and detail modifications can be made to the described embodiments without departing from the spirit or scope of the invention. For example, reflector geometries other than angled can be used. One alternate embodiment of the reflector is a combination of an angled and a parabolic reflector as shown in FIG. 29.

With benefit of this disclosure and accompanying drawings, all methods described herein can be performed without undue experimentation.

We claim:

1. An apparatus for generation of RF energy, said apparatus comprising:

(a) a dual-disc parallel plate capacitor, each said capacitor disc having a first surface facing the opposing capacitor disc and a second, opposite and parallel surface;

(b) a first and second array of metallic conductors, each array having a proximal and distal end wherein said proximal end of each array is fixed to a said second surface of a said capacitor disc; and (c) a switch located between said capacitor discs.

2. An apparatus as in claim 1 wherein said switch is a spark gap switch.

3. An apparatus as in claim 1 wherein said conductors are rods.

4. An apparatus as in claim 1 wherein said conductors are tubes.

5. An apparatus as in claim 1 wherein said conductors are slotted.

6. An apparatus as in claim 1 wherein said conductors are spaced at regular intervals in said arrays.

7. An apparatus as in claim 1 wherein part of the perimeter of at least one of said conductors substantially coincides with part of the perimeter of said second surface of each said capacitor disc.

8. An apparatus as in claim 1 further comprising a conductive plate attached to the distal end of each said array.

9. An apparatus as in claim 1 further comprising a conductive disc attached to the distal end of each said array.

10. An apparatus as in claim 1 further comprising a conductive annular disc attached to the distal end of each said array.

11. An apparatus as in claim 1 wherein said capacitor discs contain radial slots.

12. An apparatus as in claim 1 further comprising a containment structure that houses said capacitor and switch.

13. An apparatus as in claim 1 wherein at least part of the space between said capacitor disc first surfaces is insulated with a vacuum.

14. An apparatus as in claim 1 wherein at least part of the space between said capacitor disc first surfaces is insulated with a gas dielectric.

15. An apparatus as in claim 1 wherein at least part of the space between said capacitor disc first surfaces is insulated with a liquid dielectric.

16. An apparatus as in claim 1 wherein at least part of the space between said capacitor disc first surfaces is insulated with a solid dielectric.

17. An apparatus as in claim 1 further comprising an angled-plate RF wave reflector situated on the side of said arrays opposite from a desired direction of RF energy propagation.

18. An apparatus as in claim 1 further comprising a curved-plate RF wave reflector situated on the side of said arrays opposite from a desired direction of RF energy propagation.

19. An apparatus as in claim 1 further comprising an RF wave reflector situated on the side of said arrays opposite from a desired direction of RF energy propagation, said reflector comprising an angled-plate combination.

20. An apparatus as in claim 1 further comprising an RF wave reflector situated on the side of said arrays opposite from a desired direction of RF energy propagation, said reflector comprising an angled-plate and curved-plate combination.

* * * * *